US006550704B2

(12) United States Patent
Johnson et al.

(10) Patent No.: US 6,550,704 B2
(45) Date of Patent: Apr. 22, 2003

(54) LIFT FRAME FOR LARGE TUB GRINDERS

(75) Inventors: Aaron J. Johnson, Jamestown, ND (US); Dennis Mecklenburg, Jamestown, ND (US)

(73) Assignee: Duratech Industries International, Inc., Jamestown, ND (US)

( * ) Notice: Subject to any disclaimer, the term of this patent is extended or adjusted under 35 U.S.C. 154(b) by 103 days.

(21) Appl. No.: 09/823,250

(22) Filed: Mar. 30, 2001

(65) Prior Publication Data

US 2002/0139878 A1 Oct. 3, 2002

(51) Int. Cl.[7] ..... B02C 19/00
(52) U.S. Cl. ..... 241/101.2; 241/101.761; 414/498
(58) Field of Search ..... 414/498; 241/101.2, 241/101.761, 186.4

(56) References Cited

U.S. PATENT DOCUMENTS 4,448,361 A * 5/1984 Marcy ..... 241/101.761
5,082,417 A 1/1992 Vlaanderen ..... 414/498
5,427,495 A 6/1995 Vlaanderen ..... 414/498

OTHER PUBLICATIONS

Brochure on container lift from Stellar Industries Inc., unknown admitted prior art.

* cited by examiner

*Primary Examiner*—Mark Rosenbaum
(74) *Attorney, Agent, or Firm*—Westman, Champlin & Kelly, P.A.

(57) ABSTRACT

A large industrial waste tub grinder is mounted onto a lift or support frame that has a connection for a hook from a hoist on a truck so that the lift or support frame can be placed onto the truck and offloaded from the truck utilizing a conventional hook hoist. The lift or support frame supports the tub grinder on the ground surface, for in place use, the lift or support frame carries stabilizers for insuring that the lift or support frame provides a stable mounting for the tub grinder.

11 Claims, 5 Drawing Sheets

LIFT FRAME FOR LARGE TUB GRINDERS

BACKGROUND OF THE INVENTION

The present invention relates to a support and lift frame that supports a large self contained and self powered tub grinder used for comminuting industrial waste so that the grinder can be operated for a period of time at one location, but when it is desirable to move it, the lift frame and tub grinder can be lifted onto a truck equipped with a conventional hook lift or hoist for transport. The lift frame includes outriggers for stabilizing the lift frame and the attached tub grinder during use.

Tub grinders have become more prevalent in recent years for comminution of industrial wastes, such as tree branches, lumber, construction and demolition debris and similar materials. The grinders are relatively capital intensive, and at present the grinders generally are mounted onto vehicles, such as large trucks, and transported to desired locations for use.

It has been found that having a central grinder location works well. Materials at demolition or construction sites can be placed in roll-on containers and taken to the grinder site for volume reduction before being taken to a landfill or other disposal site. The hook lift equipped truck that is used for moving the roll-on containers at the present time can also be used for lifting the support frame of the present invention, so that the same truck that hauls the tub grinder can be used for hauling a number of containers to the site of the tub grinder. If the truck is equipped with a grapple loader, material can then be directly transferred from the roll-on container that the truck is carrying into the tub grinder.

When the tub grinder is to be moved, it can be lifted with the hook lift or hoist on the truck onto the same chassis that is used for the large roll-on containers holding industrial waste.

Tub grinders are well known and hook lift or hoist trucks that are used for lifting and lowering roll-on containers in the waste handling industry are well known as well.

SUMMARY OF THE INVENTION

The present invention relates to a lift or support frame that is used for mounting a large tub grinder, and which can be lifted onto a hook lift equipped truck for transport, and removed from the truck and placed onto the ground in a relatively stationary position. The lift or support frame is placed directly on the ground. The tub grinder can be attached to the frame in any suitable manner. The lift frame is lifted and lowered with the hook lift or hoist on the truck.

The lift frame carries outrigger supports, that can be lowered when the lift frame and tub grinder are resting on the ground to stabilize the lift frame and the tub grinder during use. The outriggers also can be lowered to support the frame from tending to tip when the tub is opened, which is done for cleaning the interior and the like.

The frame provides a new use for the tub grinders so that they can be supported in one location and transported to another location when desired, but without the need for having the tub grinder remain on a truck which would then prevent the truck from being used for additional purposes.

DETAILED DESCRIPTION OF THE PREFERRED EMBODIMENTS

Reference is made to U.S. patent application Ser. No. 09/753,532, filed Jan. 2, 2001, which shows constructional features of the tub grinder of the present invention. References is also made to U.S. Pat. No. 5,419,502 which shows a tub grinder.

Figure 1:
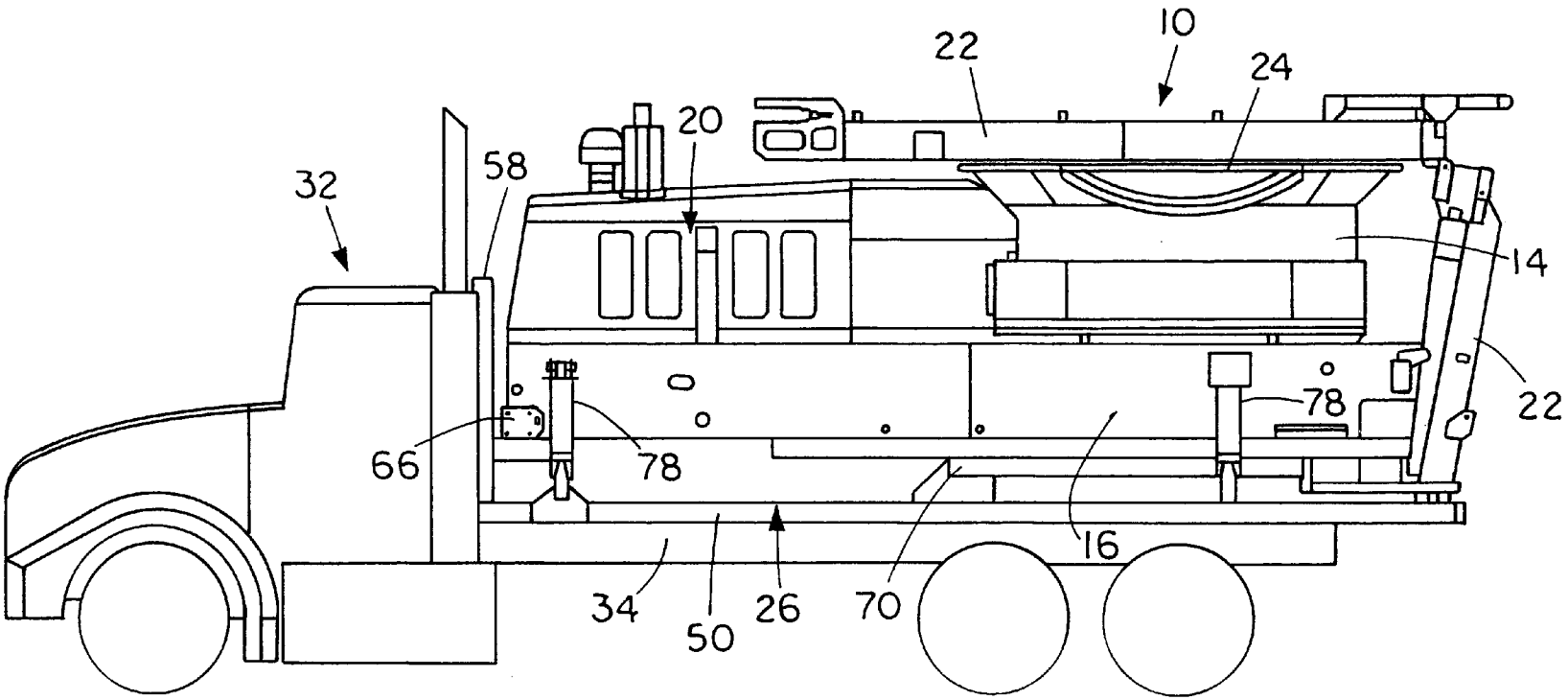
FIG. 1 is a fragmentary side elevational view of a typical hook lift truck showing a tub grinder mounted thereon using a lift frame of the present invention.

Referring to FIG. 1, in particular, a tub grinder illustrated generally at 10 has an open top, rotating tub 14 mounted onto a grinder frame 16. The tub 14 is rotatable about an upright axis, and is used for comminuting or disintegrating materials with a grinder cylinder shown schematically at 23. The tub grinder 10 has an engine 20 that is used for powering the tub and grinding cylinder, and the tub grinder includes a folding conveyor 22 that is shown in its folded position in the Figures, by way of illustration. The conveyor has a section 21 under the tub that will receive material that has been ground by a grinder cylinder 23 shown schematically in FIG. 5 that is used for disintegrating material placed in the open top of the tub. A screen 23A is provided below the rotor and material disintegrated or ground passes through the screen to conveyor section 21. The top edge of the tub is illustrated at 24, for illustrative purposes.

Figure 2:
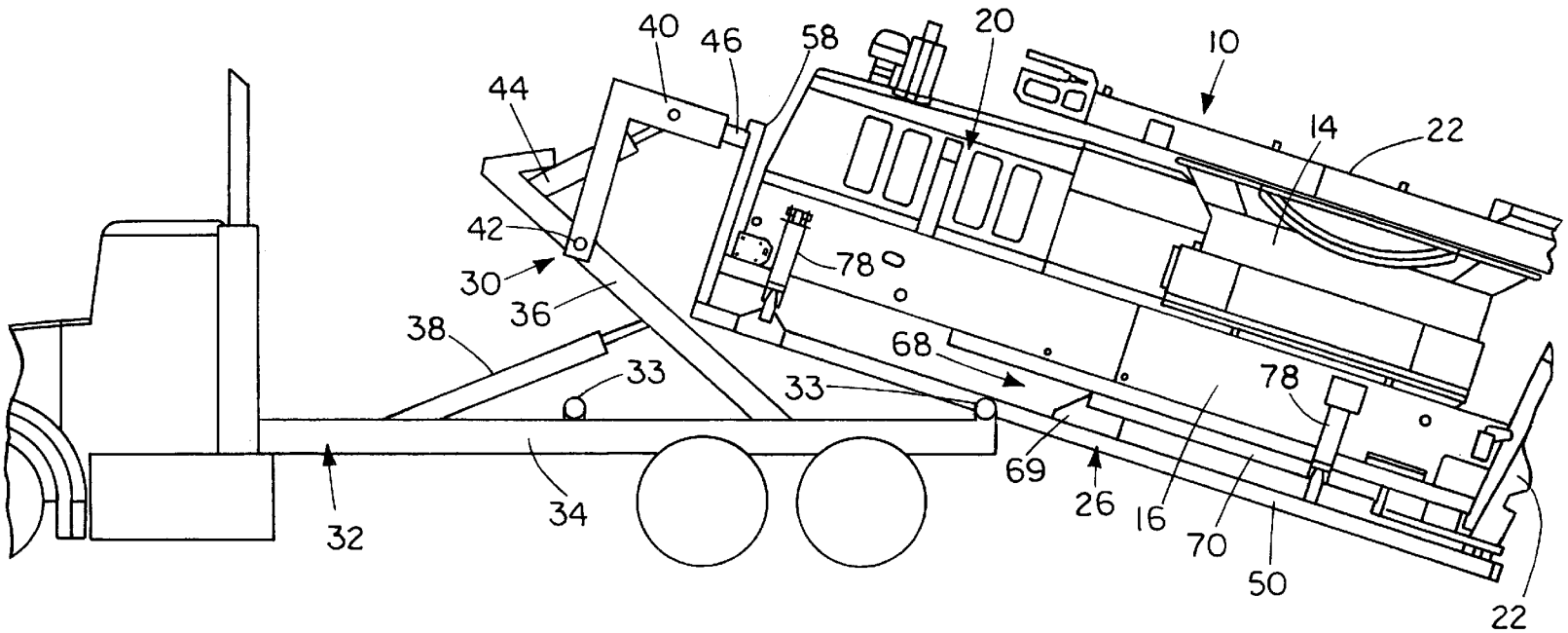
FIG. 2 is a schematic side view of the hook lift truck with the grinder of the present invention and the frame partially loaded onto hook lift truck.

The tub, engine, conveyor and frame 16 forms a self-contained unit, that is mounted onto a hook lift or support frame assembly 26. The lift or support frame assembly has various supports for supporting the grinder frame 16 and the tub grinder, which is a large, extremely heavy unit. The lift or support frame 26 is made so that it is capable of being moved and lifted from a hook lift or hoist assembly on a truck 32. The hook lift or hoist is of conventional design as shown in FIG. 2 at 30, that is mounted onto a truck 32. The truck has a truck frame 34, and the hook lift or hoist includes frame members 36, that are pivotally mounted to the truck frame 34. The members 36 are pivoted and controlled with a hydraulic cylinder 38. A hook holder arm 40 is pivotally mounted to the members 36 about an axis 42, and a hydraulic cylinder 44 is used for controlling the pivoting of the arm 40. The arm 40 carries a large hook indicated at 46 which will hook onto the front of lift frame 26 that supports the tub grinder 10.

The hook lift or hoist 30 is a conventional frame used on trucks for hauling and lifting roll-on containers, and is made by Stellar Industries, Inc., 280 West 3$^{rd}$ Street, Garner, Iowa. Hook lifts or hoists sold under the trademark STELLAR SHUTTLE by Stellar Industries have been found to be suitable.

Additional showings of hoist frames by Stellar Industries are illustrated in U.S. Pat. Nos. 5,082,217 and 5,427,495. It should be noted that the hook that is used for this application is similar to that shown in FIG. 1 of Patent '495 which is labeled as prior art, but the pivoting hoist is of the form shown in the rest of the Figures of that patent with the modifications of having a single arm protruding rearwardly for hooking onto the frame 26.

Figure 3:
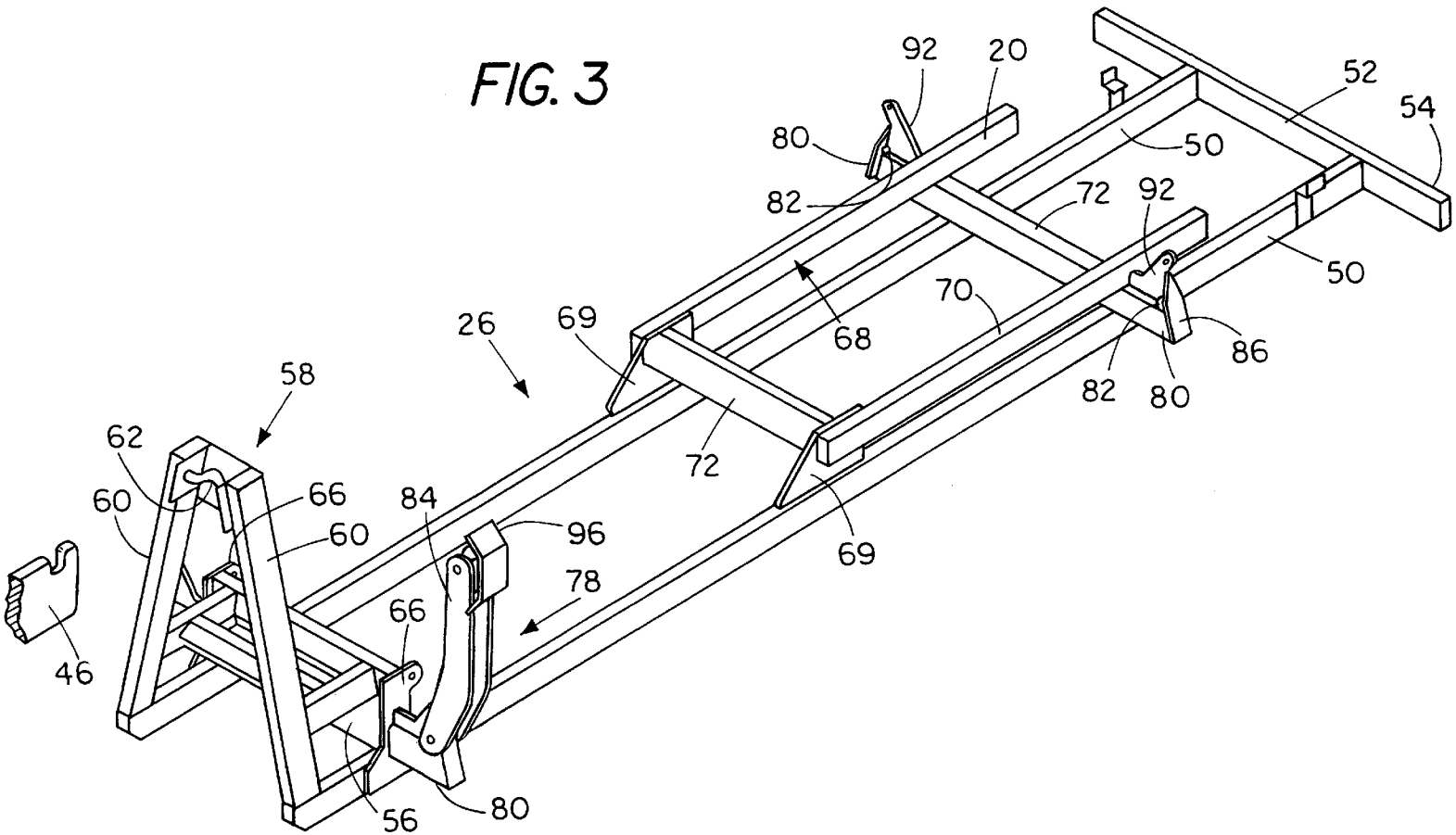
FIG. 3 is a perspective view of the lift frame used for supporting a tub grinder.
Figure 4:
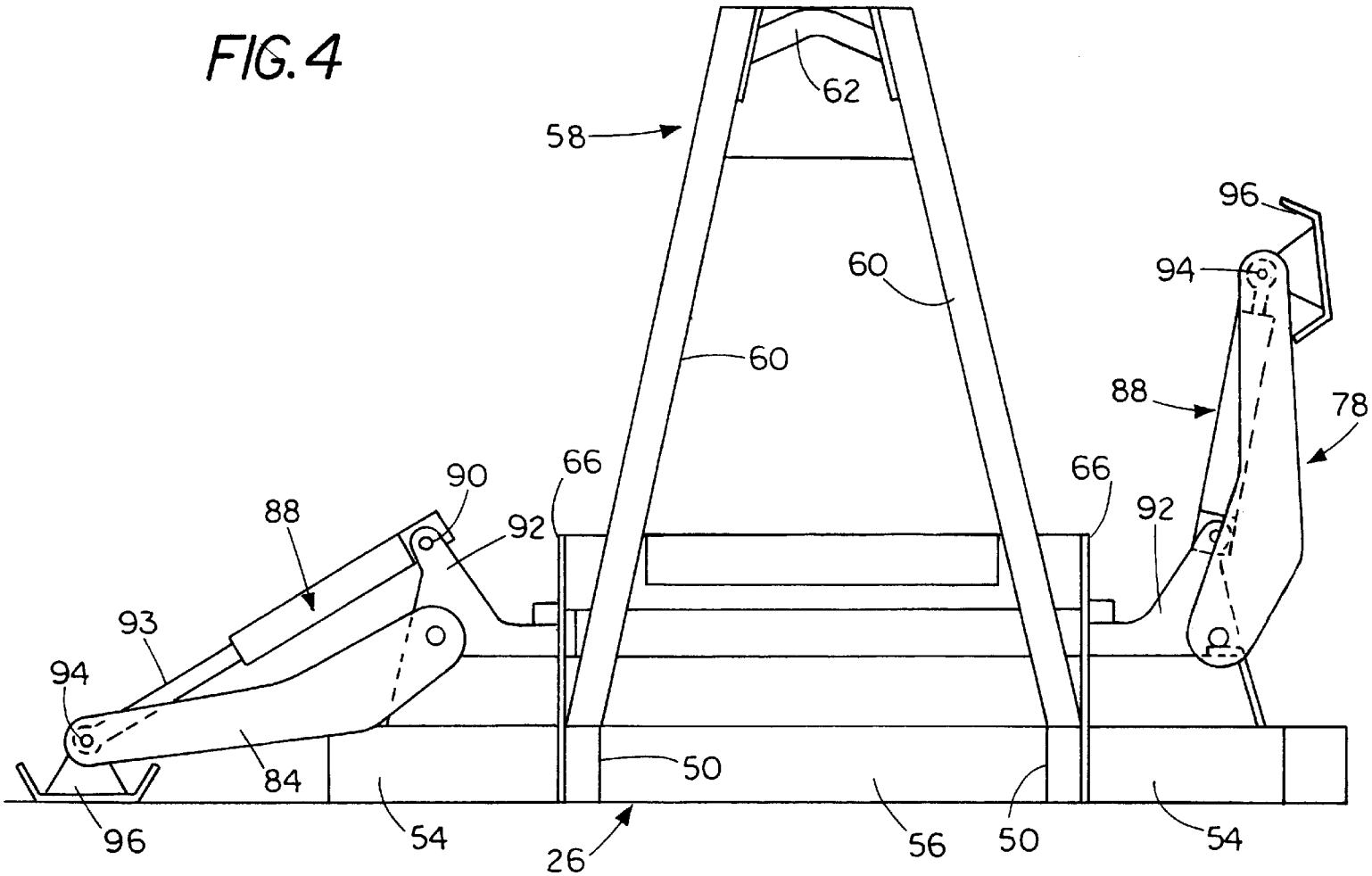
FIG. 4 is a front elevational view of the lift frame of FIG. 3.

Lift or support frame 26 is shown in perspective view in FIG. 3 with the grinder removed for sake of clarity. Also, FIG. 4 shows the front view of the frame 26. Frame 26 includes longitudinally extending main frame rails 50, that are joined together with a rear cross member 52, that as can be seen extends laterally outwardly from rails 50. Support sections 54 are provided so the lateral width of the cross member 52 is substantially greater than the spacing of the rail members 50 which are made to fit onto conventional rollers or tracks 33 on the truck frame 34 for the truck 32 to lift the lift or support frame 26.

The forward end of the lift or support frame 26 is joined with a cross member 56, which is positioned between the longitudinal rail or frame members 50. An A-frame or lift arm 58 has upright members 60 that taper together upwardly to support a hook rail 62 on which a schematically shown hook 46 from the hook lift on the truck will engage. The upstanding A-frame or arm is used for lifting and pulling the lift or support frame 26 onto the truck.

Suitable bracing on the frame is provided, as shown. The cross member 56 supports side plates 66 that have apertures for receiving end portions of the grinder frame 16 of the tub grinder so that the tub grinder can be pinned into place on those portions.

Additionally, the lift or support frame 26 has a raised support saddle 68, that has longitudinal members 70, and cross members 72. The members 70 are supported on brackets 69 at the front and are spaced above the longitudinal rails 50. The space between members 70 and the cross-members 72 receives the lower portions of the grinding cylinder 23 that are below the floor of the tub grinder, as illustrated schematically. Also, the members 70 provide clearance for the horizontal portion of a conveyor section 21 that receives ground material and transfers it to the folding conveyor 22.

The folding conveyor 22 will receive material from the lower conveyor sections 21 underneath the tub, as the material is ground.

The frame 26 has four retractable stabilizer assemblies shown generally at 78, which are substantially identical, and are mounted on opposite sides of the frame adjacent the front and rear ends.

The stabilizer assemblies 78 are shown somewhat schematically. There are a plurality of stabilizer supports or anchors 80, extend laterally out from the longitudinal rail members 50. The stabilizer supports include hubs 82 for mounting pivoting stabilizer arms 84. The stabilizer arms 84 are channel shaped and are pivotally mounted on the hubs 82. The stabilizer arms are reinforced suitably. The side walls of the channel shaped stabilizer arms fit to the outside of the hubs, and also straddle upright members 86 forming part of the support for the stabilizers.

The stabilizers are controlled for movement about the axis of the hubs 82 by a hydraulic actuator 88. The hydraulic actuator 88 is pivotally mounted as at 90 to an upright flange 92, in a suitable manner. The hydraulic actuator 88 for each of the stabilizers has an extendable and retractable rod 93 that has its rod end pivotally mounted on a pin 94 that also mounts a stabilizer foot 96. By extending and retracting the actuators 88, the stabilizer arms can be pivoted from a raised position or transport position shown on the right-hand side of FIG. 4, to a stabilizing or lowered position shown on the left-hand side of FIG. 4.

It can be seen that the stabilizers can be lowered to support part of the tub grinder weight to stabilize the lift frame 26. While not contemplated for operation the frame can be lifted off the ground.

Figure 5:
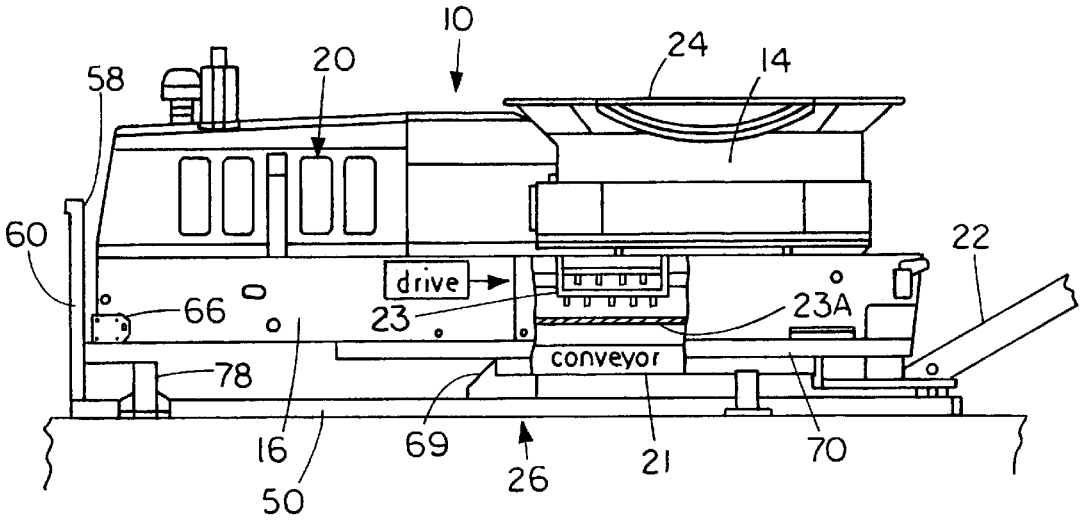
FIG. 5 is a side elevational view of a tub grinder supported on the ground on the lift frame.

The weight carried by the stabilizer arms can be such that it insures that the lift frame 26 is not likely to rock or tilt, and that there is a firm base for supporting the grinder when it is in operation grinding materials. When the frame 26 and the tub grinder 10 are supported on the ground, as shown in FIG. 5, the open top of the tub is accessible and material can be dropped into the tub from the top in a normal manner. The conveyor is shown removed from its transport position over the top of the tub in FIG. 5. The top of the tub grinder is lowered substantially over when it is mounted on a truck or semi-trailer. The tub grinder together with its drive motor can remain on the frame 26 and be used for disintegrating material that is brought to the site of the tub grinder.

A roll-on container truck can deliver containers of the material to be ground up, and the material then can be loaded into the tub grinder with a grapple or front-end loader as desired. The lower height of the top of the tub, or in other words the lower loading height, will permit smaller loaders, such as skid steer loaders, to be used for handling the debris.

When the tub grinder is to be moved, the hook 46 mounted on the lift or hoist 30 is lowered to a position where it will go under the cross member 62 on the lift frame, and then the hydraulic actuators 38 and 44 are operated to lift the A-frame 58, and the front end of the lift frame 26 (after the stabilizer arms have been raised to the position shown in FIG. 5). The lift frame and tub grinder then can be tilted to the position shown in FIG. 2 where the longitudinal rails 50 will roll onto suitable rollers on the truck frame 34 so that the unit can be loaded. Its fully loaded position is shown in FIG. 1, and the hook lift or hoist is moved to a position so that the arm 40 extends uprightly just ahead of the A-frame 58 on the tub grinder frame 26.

The removal process is the opposite movement, and is accomplished quite easily. Once loaded, the truck of course can be moved in any desired location before the tub grinder is off loaded. The spacing of the longitudinal rail members 50 can be such that they will roll on rollers used for roll off containers, and the overall assembly can easily be modified to fit existing hook lift or hoist trucks.

Once the tub grinder is installed on the frame and is securely anchored, it will remain on the frame and moved from site to site for use as desired.

Although the present invention has been described with reference to preferred embodiments, workers skilled in the art will recognize that changes may be made in form and detail without departing from the spirit and scope of the invention.

What is claimed is:

1. A lift frame and tub grinder combination comprising a tub grinder having a grinder frame, a grinder cylinder and conveyor below a tub on the tub grinder and extending below the grinder frame, a power unit on the grinder frame for powering the tub grinder, the lift frame used in combination with a hoist mounted on a hauling truck, the hoist being movable between an extended offloading position and a retracted transport position to move the lift frame into overlying relation with the truck for subsequent transport, the lift frame comprising an elongated frame having a pair of spaced apart rails extending between opposite ends of the frame:

an upstanding arm at one end of the lift frame, and adapted for releasable engagement with the hoist whereby operation of the hoist causes the frame to drawn onto the truck;

cross bars for holding the spaced apart rails in an assembly, said lift frame having spaced, longitudinally extending support members for engaging lower portions of the grinder frame of the tub grinder with the grinding cylinder and conveyor between the support members and at a height above the rails, whereby the tub grinder and lift frame can be moved onto the truck and offloaded from the truck by operation of the hoist, and the tub grinder being operable when mounted on the lift frame.

2. The lift frame of claim 1 wherein the upstanding arm comprises an upright support frame at a leading end of the lift frame, said upright support frame having a receptacle for receiving an attachment hook on the hoist of the truck.

3. The lift frame of claim 1 and a plurality of stabilizers mounted on the lift frame, said stabilizers being movable from a position wherein they engage the ground laterally outwardly from the spaced apart rails to a position wherein outer ends of the stabilizers are substantially above the spaced apart rails.

4. The frame of claim 3, wherein said support members include raised frame members parallel to the spaced apart rails that hold the grinder frame spaced above the spaced apart rails to provide for clearance for operating components of the grinder.

5. The lift frame of claim 3, wherein said stabilizers comprise arms that are pivotally mounted to the lift frame on opposite sides thereof, and stabilizer hydraulic actuators connected between the lift frame and the stabilizer arms for controlling pivotal movement of the stabilizer arms about their pivotal mounting to the lift frame.

6. A tub grinder and lift frame combination comprising a tub grinder having an open top tub for receiving materials to be ground, and a rotating grinding cylinder for grinding the material, comprising a separate lift frame supporting the tub grinder relative to a supporting surface, said lift frame having a pair of substantially parallel longitudinally extending rails, a support structure mounted on the rails supporting the tub grinder at a height sufficient to provide clearance for tub grinder components relative to a support surface, and an upright frame at a forward end of the lift frame, said upright frame having a connector for attaching to a hoist on a truck, such that a lifting load applied to the upright frame will lift the forward end of the lift frame and tub grinder as a unit, for permitting movement of the lift frame and tub grinder onto a truck having the hoist.

7. The tub grinder and lift frame combination of claim 6 and a plurality of stabilizers mounted on the lift frame, said stabilizers being on opposite sides of the lift frame and having arms movable from a position wherein the stabilizers engage a support surface laterally outwardly from the rails, to a position wherein the outer ends of the stabilizers are raised upwardly.

8. The tub grinder and lift frame combination of claim 7, wherein said stabilizers comprise arms that are pivotally mounted to the lift frame on opposite sides thereof, and hydraulic actuators connected between the lift frame and the stabilizer arms for controlling pivotal movement of the stabilizer arms about their pivotal mounting to the lift frame, said hydraulic actuators controlling loads supplied to the lift arms to provide stability to the lift frame and tub grinder combination.

9. The tub grinder and lift frame combination of claim 6, wherein said lift frame supports a power unit for driving the tub grinder adjacent the forward end of the lift frame, the tub grinder being drivable when the support frame is on the supporting surface and when on the truck.

10. The tub grinder and lift frame combination of claim 6, wherein said support members comprise a cradle for supporting the tub grinder below the rotatable tub at a height such that the support surface is spaced from the tub grinder sufficient to provide space for a conveyor.

11. The tub grinder and lift frame combination of claim 6, wherein the forward end of said tub grinder is secured to a portion of the lift frame.

* * * * *